United States Patent [19]

Nobel

[11] Patent Number: 4,478,692

[45] Date of Patent: Oct. 23, 1984

[54] ELECTRODEPOSITION OF PALLADIUM-SILVER ALLOYS

[75] Inventor: Fred I. Nobel, Sands Points, N.Y.

[73] Assignee: LeaRonal, Inc., Freeport, N.Y.

[21] Appl. No.: 561,152

[22] Filed: Dec. 15, 1983

Related U.S. Application Data

[63] Continuation-in-part of Ser. No. 452,144, Dec. 22, 1982, Pat. No. 4,465,563.

[51] Int. Cl.[3] ..... C25D 3/56; C25D 3/64

[52] U.S. Cl. ..... 204/43 R; 204/43 N

[58] Field of Search ..... 204/43 R, 43 N, 123, 204/43.1, 44.6

[56] References Cited

U.S. PATENT DOCUMENTS

| | | | |
|---|---|---|---|
| 3,053,714 | 9/1962 | Medina | 204/43 R |
| 4,098,656 | 7/1978 | Deuber | 204/47 |
| 4,242,180 | 12/1980 | Heppner et al. | 204/43 N |
| 4,246,077 | 1/1981 | Hradil et al. | 204/43 R |
| 4,269,671 | 5/1981 | Cohen et al. | 204/23 |

FOREIGN PATENT DOCUMENTS

| | | | |
|---|---|---|---|
| 72167 | 4/1970 | Fed. Rep. of Germany | 204/43 R |
| 38-19825 | 9/1963 | Japan | 204/43 R |
| 57-143485 | 4/1982 | Japan | 204/43 R |
| 221452 | 4/1973 | U.S.S.R. | 204/43 R |
| 379676 | 8/1973 | U.S.S.R. | 204/43 N |

OTHER PUBLICATIONS

"Bath for the Preparation of Silver-Palladium Alloys'-'-IBM Technical Disclosure Bulletin, vol. 7, No. 3, p. 177, 8/64.

"Electrodeposition of a Silver-Palladium Alloy" L. Domnikov, *Metal Finishing*, 9/69.

*Primary Examiner*—G. L. Kaplan

*Attorney, Agent, or Firm*—Pennie & Edmonds

[57] ABSTRACT

Aqueous electroplating solutions for the electrodeposition of palladium-silver alloys comprising a soluble palladium compound, a soluble silver compound and an excess of a strong acid in an amount sufficient to maintain the palladium and silver compounds in solution and process for electrolytically plating palladium-silver alloys.

11 Claims, No Drawings

ELECTRODEPOSITION OF PALLADIUM-SILVER ALLOYS

This application is a continuation-in-part application of U.S. Ser. No. 452,144, filed Dec. 22, 1982 and now U.S. Pat. No. 4,465,563.

FIELD OF THE INVENTION

The invention relates to the electrodeposition of palladium-silver alloys and to electrolytic solutions containing the alloying metals palladium and silver from which the alloys are deposited.

BACKGROUND OF THE INVENTION

Palladium-silver alloys have many uses. They are particularly useful in the electronic field as electrical contacts and connectors in place of pure gold or pure palladium. No process is known today, to the applicant's knowledge, which is capable of electrolytically plating palladium-silver alloys from an electrolytic plating solution from a practical or commercial standpoint. Palladium-silver alloys are presently used as electrical contacts or connectors in the form of wrought alloys. These alloys have also been prepared for use as electrical contacts or connectors by first plating pure palladium and then pure silver onto the desired surface from separate electroplating solutions and the layered deposits fused by heat to form the alloy. One of the reasons why no practical or commercial electroplating process is available for depositing palladium-silver alloys is that the plating potentials of palladium ions and silver ions are too far apart, so that no single plating potential will permit the deposition of both metals at the same time to form a sound deposit. It would obviously be an advantage of the industry if electrical contacts or connectors could be directly electrolytically plated with the desired palladium-silver alloy.

SUMMARY OF THE INVENTION

This invention relates to aqueous electroplating solutions containing palladium and silver and an excess of a strong acid capable of keeping both the palladium and silver in solution. This combination surprisingly results in bringing the plating potential of each metal sufficiently close together so that a single potential is capable of simultaneously depositing both the palladium and silver metals to form alloy deposits.

DETAILED DESCRIPTION OF THE INVENTION

The strong acids that can be used according to the invention include organo sulfonic acids, such as alkane sulfonic acids, aryl sulfonic acids and alkane aryl sulfonic acids, organo phosphonic acid and strong inorganic acids, such as sulfuric and phosphoric acid. The strong acids must be capable of maintaining the silver and palladium in solution and not adversely attack the base metals being plated.

The organo sulfonic acids can contain one or a plurality of sulfonic acid groups. Some specific examples include alkane sulfonic acids having between 1 and 5 carbon atoms in the alkyl group, such as methane sulfonic acid, phenol sulfonic acid and toluene sulfonic acid. The organo sulfonic acids can also contain other functional groups, such as alkanol sulfonic acids, e.g., propanol sulfonic acids. The only limiting criteria known today with respect to the scope of organo sulfonic acids that can be used is that they should have sufficient solvent power to keep the palladium and silver compounds in solution during the plating operation and bring the plating potentials of palladium and silver sufficiently close to enable the plating of both metals simultaneously to produce the desired alloy deposit. The organo sulfonic acids are well known and have been used in electrolytic plating solutions. See, for example, U.S. Pat. Nos. 2,525,942; 2,195,409; 905,837; 3,905,878; 4,132,610; INTERFINISH 80, "Electrodeposition of Bright Tin-Lead Alloys From Alkanolsulfonate Bath", by N. Dohi and K. Obata; Industrial Research Institute of Hyogo Pref. Kobe, Japan; and Proceeding of Electroplating Seminars, Showa 53, July 7, 1978, by N. Dohi and K. Kohata, "Bright Solder and Indium Plating From Methane Sulfonic Acid". All of the above disclosures are incorporated herein by reference.

The organo phosphonic acids that can be used include those disclosed in U.S. Pat. No. 3,672,696 to Nobel et al. issued June 27, 1972. The disclosure of the phosphonic acids in this patent is incorporated herein by reference. The organo-phosphonic acid can contain other functional groups such as carboxylic acid groups. Again the only limiting criteria known with respect to the scope of the organo-phosphonic acids is that they should be strong acids having sufficient solvent power to keep the palladium and silver compounds in solution and render the plating potentials of palladium and silver sufficiently close to enable the plating of both metals simultaneously to produce an alloy deposit.

Nitric acid is normally not recommended since this acid in equally large amounts would cause a very severe attack on the base metals that are usually plated with pure palladium or pure gold and intended to be plated with the solutions of this invention. Similarly, hydrochloric acid is not recommended since silver chloride would normally precipitate. This is not to say, however, that nitric acid or hydrochloric acid cannot be used under any circumstances. The other acids, such as sulfuric and phosphoric, are simply much more advantageous and easier to use.

The form in which palladium and silver can be added to the solution is not critical so long as the metals remain soluble in the electroplating solutions and do not cause precipitation. Examples of compounds that can be employed in the solutions include palladium diamino dinitrite (P-salt), palladium nitrate, palladium sulfate, palladium phosphate and the organo sulfonic or phosphonic acid salts of palladium. The use of palladium chloride is not recommended, since this could cause precipitation of silver chloride. Silver can be added in various forms such as silver nitrate, silver sulfate or an organo sulfonic acid or phosphonic acid silver salt.

The use of silver has also been found to act as a brightener in strong acid-palladium plating solutions. This is quite a surprising result in view of the disclosure in ELECTRODEPOSITION OF ALLOYS, Vol. I, 1963 (pages 619–621) by A. Brenner.

The amount of strong acid should be sufficient to produce the desired alloys. The optimum amount will depend upon the particular solution to be used, but in all cases a sufficient excess of free and uncombined strong acid should be present to prevent precipitation of the metals, particularly palladium, to render the plating potentials of the palladium and silver sufficiently close to produce the desired true alloy and to maintain uniformity of the alloy deposit. It is generally recommended that the concentration of the strong acid be in excess of about 50 ml/l or g/l; 100 to 300 ml/l or g/l is preferable, but amounts higher than 300 ml/l or g/l can be used if desired.

The temperature of the bath during deposition should be sufficient to maintain the palladium and silver in solution. The particular temperature employed to accomplish this objective will depend upon amounts of silver and/or palladium in the solution, the amount of strong acid, the particular palladium and/or silver salts being used, etc., and can be readily determined by routine experimentation. Generally a bath temperature of between about 100° F. and 175° F. has been found to be sufficient in most cases.

the anode is preferably platinum plated titanium which is commonly used in plating pure palladium. The cathode can be of most any base metal, but it is preferred to initially plate the base metal cathode with a thin coating of a noble metal, or a noble metal alloy, preferably silver, gold or palladium to protect the base metal cathode from initial attack before the palladium-silver alloy plating begins and to prevent the silver and/or palladium content in the solution from plating by immersion (electroless plating) on the base metal cathode.

The most common and preferred palladium-silver wrought alloys in use today as electrical contacts or connectors contain approximately 60% palladium and 40% silver. As is known in the art, pure silver is not acceptable as an electrical contact or connector because of its inherent creep characteristics. Thus, the palladium-silver alloys used for this purpose should have at least about 50% palladium. Alloys of very high palladium content, such as 95% with 5% silver, might be useful as electrical contacts or connectors, but the cost would begin to approach that of pure palladium alone. Thus, it is advantageous to produce a palladium-silver alloy having a silver content sufficiently high to reduce the cost of pure palladium but also sufficiently low to prevent the creeping characteristics of pure silver or high silver alloys. As can be seen from the following examples, palladium-silver alloys containing 50% to 60% palladium can readily be deposited by electrolytic deposition.

The palladium to silver ratio will, of course, vary depending on the alloy desired, advantageously an alloy containing at least about 50% palladium. Advantageously the palladium to silver ratio, as metal, should be in excess of about 6 to 1. A palladium to silver ratio of 12 to 1 can advantageously be used to produce an acceptable alloy. As the ratio to silver metal is increased, the amount of silver content in the deposited alloy is slightly lowered. For example, using a palladium to silver ratio of 24 to 1 produces an acceptable alloy but the silver content is a little lower than those alloys obtained using a ratio of about 12 to 1.

In each of the following Examples brass cathodes were used which were previously cleaned in the conventional manner and strike-plated with about 3 to 5 micro inches of palladium to prevent immersion deposition. The anodes in each Example are platinum plated titanium.

EXAMPLE 1

12 g/l of palladium metal as palladium diamino dinitrite (P-salt) together with 1 g/l of silver metal as silver nitrate contained in a 0.1N aqueous solution are mixed and dissolved in 200 ml/l of 100% methane sulfonic acid. The palladium diamino dinitrite is first added to the methane sulfonic acid. When this palladium salt is added, gassing occurs, which eventually stops, and the palladium salt is then in solution. The silver nitrate is then introduced into the solution and water is added to form the required volume. Plating is carried out at 175° F. at about 2 ASF under mild agitation resulting in a palladium-silver alloy containing 54% palladium and 46% silver. At 20 ASF an alloy is deposited containing 61% palladium and 39% silver. The deposited alloys were sound, semi-bright deposits.

EXAMPLE 2

Example 1 is repeated using palladium nitrate and 300 ml/l of methane sulfonic acid. A sound, semi-bright palladium-silver alloy is deposited at 2 ASF.

EXAMPLE 3

Example 1 is repeated substituting 500 ml/l of a 65% aqueous solution of phenol sulfonic acid. Sound, semi-bright palladium-silver alloys are deposited at 2 ASF and 5 ASF.

EXAMPLE 4

Example 1 is repeated substituting 300 g/l of toluene sulfonic acid (monohydrate) for the methane sulfonic acid and palladium sulfate for the palladium diamino dinitrite. Sound, silver-gray alloys are deposited at 2 and 5 ASF.

EXAMPLE 5

Example 1 is repeated using 300 ml/l of methane sulfonic acid and adding the palladium and silver metals as the methane sulfonic acid salts. Good plated palladium-silver alloys are obtained at 2, 5 and 15 ASF.

Best results to date have been obtained using palladium diamino dinitrite. When palladium compounds other than palladium diamino dinitrite are employed, a small amount, e.g., about 5 g/l of a nitrite salt, such as sodium nitrite, has been found to improve the current density range of the plating solutions. The exact or optimum amounts of the nitrite salts which can be added have not been determined, but this information can readily be obtained by routine expermentation. Large amounts of the nitrite salt, e.g. about 15 g/l, have so far been found to reduce the cathode efficiency.

EXAMPLE 6

12 g/l of palladium metal as palladium sulfate together with 0.7 g/l of silver metal as silver nitrate are mixed with 200 ml/l sulfuric acid and water is added to form the required volume. Plating is then carried out at 130° F. at 5 to 30 ASF using cathode rod agitation. Sound deposits are obtained that are dull to semi-bright and the deposit analyzed 50% palladium and 50% silver.

EXAMPLE 7

12 g/l palladium metal as palladium phosphate togther with 1 g/l of silver metal as silver methane sulfonic acid are mixed with 100 ml/l of phosphoric acid. Water is added to form the required volume. Plating is carried out at 110° F. at 3 to 10 ASF using cathode rod agitation. Sound deposits are obtained that are dull to semi-bright and the deposit analyzed approximately 50% palladiumm and 50% silver.

EXAMPLE 8

10 g/l of palladium metal as palladium methane sulfonate together with 0.5 g/l of silver metal as silver nitrate are dissolved in 150 ml/l of nitrilo trimethyl phosphonic acid. Plating is carried out at 110° F. at 3 to 15 ASF using cathode rod agitation. Sound deposits are obtained that are dull to semi-bright and the deposit analyzed approximately 50% palladium and 50% silver.

I claim:

1. An aqueous electroplating solution for the electrodeposition of palladium-silver alloys comprising a soluble palladium compound, a soluble silver compound and an excess of a strong acid in an amount sufficient to maintain the palladium and silver compounds in solution without the addition of chloride or bromide ions and to bring the plating potential of palladium and silver sufficiently close to enable the plating of palladium and silver simultaneously to produce an alloy deposit.

2. The aqueous solution of claim 1 in which the palladium compound is palladium diamino dinitrite, palladium sulfate, palladium phosphate, a palladium organo sulfonate or a palladium organo phosphonate.

3. The aqueous solution of claim 2 which contains a sufficient amount of a nitrite salt to improve the current density range of the plating solution.

4. The aqueous solution of claim 3 which contains a palladium to silver ratio, as metal, of at least about 6 to 1.

5. The aqueous solution of claim 4 in which the strong acid is in excess of about 50 m/l or g/l.

6. The aqueous plating solution of claim 5 in which the strong acid is an organo phosphonic acid, sulfuric acid or phosphoric acid.

7. A process for electrolytically plating palladium-silver alloys which comprises electrolyzing an aqueous solution containing a soluble palladium compound, a soluble silver compound and an excess of a strong acid in an amount sufficient to maintain the palladium and silver compounds in solution without the addition of chloride or bromide irons and to bring the plating potential of palladium and silver sufficiently close to enable the plating of palladium and silver simultaneously to produce an alloy deposit.

8. The process according to claim 7 in which the palladium compound is palladium diamino dinitrite, palladium sulfate, palladium phosphate, a palladium phosphonate or a palladium sulfonate.

9. The process according to claim 8 in which the electrolytic solution contains a sufficient amount of a nitrite salt to improve the current density range of the plating solution.

10. The process according to claim 8 in which the palladium to silver ratio, as metal, is at least about 6 to 1.

11. The process according to claim 10 in which the strong acid is in excess of about 50 ml/l or g/l.

* * * * *

UNITED STATES PATENT AND TRADEMARK OFFICE

CERTIFICATE OF CORRECTION

PATENT NO. : 4,478,692

DATED : October 23, 1984

INVENTOR(S) : Fred I. Nobel

It is certified that error appears in the above-identified patent and that said Letters Patent is hereby corrected as shown below:

The term of this patent subsequent to August 14, 2001 has been disclaimed.

Signed and Sealed this

*Fifth* Day of *February 1985*

[SEAL]

*Attest:*

DONALD J. QUIGG

*Attesting Officer*

*Acting Commissioner of Patents and Trademarks*